US009030314B2

(12) United States Patent
Piccolo, III et al.

(10) Patent No.: US 9,030,314 B2
(45) Date of Patent: May 12, 2015

(54) METHOD FOR INSPECTING AND TESTING NOTIFICATION APPLIANCES IN ALARM SYSTEMS

(71) Applicant: SimplexGrinnell LP, Westminster, MA (US)

(72) Inventors: Joseph Piccolo, III, Fitzwilliam, NH (US); David Dahlstrom, Hubbardston, MA (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 70 days.

(21) Appl. No.: 13/836,685

(22) Filed: Mar. 15, 2013

(65) Prior Publication Data

US 2014/0266675 A1 Sep. 18, 2014

(51) Int. Cl.
*G08B 29/00* (2006.01)
*G08B 29/14* (2006.01)

(52) U.S. Cl.
CPC ..... *G08B 29/00* (2013.01); *G08B 29/14* (2013.01)

(58) Field of Classification Search
CPC ..... G08B 17/00; G08B 19/00; G08B 21/182; G08B 25/10; G08B 25/14; G05B 23/00
USPC ..... 340/514, 506, 517, 539.1, 535, 539.15; 315/129, 133
See application file for complete search history.

(56) References Cited

U.S. PATENT DOCUMENTS

| | | | | |
|---|---|---|---|---|
| RE41,871 | E * | 10/2010 | Capowski et al. | 340/514 |
| 8,228,182 | B2 * | 7/2012 | Orsini et al. | 340/514 |
| 2005/0052927 | A1 * | 3/2005 | Barrieau | 365/222 |
| 2012/0229269 | A1 * | 9/2012 | McEvoy | 340/506 |
| 2013/0246850 | A1 * | 9/2013 | Gelter et al. | 714/32 |

FOREIGN PATENT DOCUMENTS

EP 0144250 A2 6/1985

OTHER PUBLICATIONS

International Search Report and Written Opinion mailed May 16, 2014 for PCT application PCT/US2014/018174 Filed Feb. 25, 2014.

* cited by examiner

*Primary Examiner* — Phung Nguyen
(74) *Attorney, Agent, or Firm* — Kacvinsky Daisak Bluni PLLC

(57) ABSTRACT

A method for inspecting notification appliances in an alarm system. The method may include placing the alarm system in an inspection mode, whereby a verification indicium on each notification appliance being inspected is activated. The method may further include performing a physical inspection of a notification appliance, as well as actuating an input device on the notification appliance whereby the verification indicium on the notification appliance is deactivated. A first alternative method may include placing the alarm system in a test mode, whereby a verification indicium on each notification appliance being inspected and tested is activated. The first alternative method may further include performing a physical inspection of a notification appliance, as well as actuating an input device on the notification appliance whereby the verification indicium on the notification appliance is deactivated and a notification feature of the notification appliance is activated for a predefined amount of time.

25 Claims, 10 Drawing Sheets

METHOD FOR INSPECTING AND TESTING NOTIFICATION APPLIANCES IN ALARM SYSTEMS

FIELD OF THE DISCLOSURE

The disclosure relates generally to the field of alarm systems, and more particularly to improved methods for inspecting and testing notification appliances in such systems.

BACKGROUND OF THE DISCLOSURE

Alarm systems, such as fire alarm systems, typically include a plurality of notification appliances, such as horn/strobe units, that are installed throughout a monitored building and are configured to be activated upon the detection of an alarm condition, such as the presence of fire or smoke. Occupants of the building may thereby be notified of a potentially hazardous condition and may evacuate the building or take other action before being harmed. It is therefore critically important that notification appliances of alarm systems always be in good working order.

Governmental entities may require that notification appliances, and particularly those of fire alarm systems, be tested and/or inspected periodically to verify that such appliances are operating properly and have not been physically compromised in some way (e.g. painted over, loosened from a mounting, etc.). Such testing and inspection are typically performed by one or more designated inspectors who walk through an entire monitored building and physically visit each and every notification appliance installed therein. The inspectors may visually inspect each appliance and may activate each appliance for a predetermined amount of time to verify functionality. The inspectors may thereafter manually note their observations to create a record of the inspection.

Because testing and physically inspecting notification appliances can be time-consuming and may require visiting areas of a building that are not readily accessible, it is not uncommon for inspectors to take certain shortcuts, or to be suspected of taking shortcuts. For example, an inspector might avoid testing and inspecting notification appliances that are inconveniently located or that the inspector deems to be of lessor importance than others (e.g. appliances that are located in less populated areas of a building).

A further shortcoming associated with traditional physical testing and inspection methods is that there is no convenient way to keep track of which notification appliances have been tested and inspected and which have not. Inspectors must generally devise manual, ad hoc or procedural methods for dealing with this issue. Such manual tracking methods can be highly complex and cumbersome, especially if numerous inspectors are involved and/or if the testing and inspection of a system must be performed over a number of days. Moreover, such methods are susceptible to a certain level of inconsistency that is naturally attendant with any complex, manual task of this type, which may result in some devices being tested and inspected more than once or, worse, may result some devices not being tested and inspected at all.

Yet another shortcoming associated with traditional physical testing and inspection methods is that notification appliances can be very difficult to find, especially in large buildings in which appliances may be installed in obscure or out-of-the-way locations. This may result in a significant amount of time being spent backtracking through a building to search for "stray" notification appliances that were missed on a first pass, and/or may lead to notification appliances being completely neglected by accident.

SUMMARY

In view of the foregoing, it would be advantageous to provide inspectors and other interested parties with convenient means for verifying that each and every notification appliance in an alarm system has been tested and physically inspected. It would further be advantageous to provide convenient means for keeping track of which notification appliances in an alarm system have been tested and inspected and which have not. It would further be advantageous to provide convenient means for allowing inspectors to easily find notification appliances in a building. In accordance with the present disclosure, methods for inspecting and testing notification appliances in alarm systems are disclosed.

An exemplary method in accordance with the present disclosure may include placing an alarm system in an inspection mode, whereby a verification indicium on each notification appliance being inspected is activated. The method may further include performing a physical inspection of a notification appliance, as well as actuating an input device on the notification appliance whereby the verification indicium on the notification appliance is deactivated.

A method is disclosed that includes placing an alarm system in a test mode, whereby a verification indicium on each notification appliance being inspected and tested is activated. The method may further include performing a physical inspection of a notification appliance, as well as actuating an input device on the notification appliance whereby the verification indicium on the notification appliance is deactivated and a notification feature of the notification appliance is activated for a predefined amount of time.

A method is disclosed that includes placing an alarm system in an active inspection mode, whereby a notification feature of each notification appliance being inspected is activated. The method may further include performing a physical inspection of a notification appliance, as well as actuating an input device on the notification appliance whereby the notification feature of the notification appliance is deactivated.

DETAILED DESCRIPTION

Figure 1:
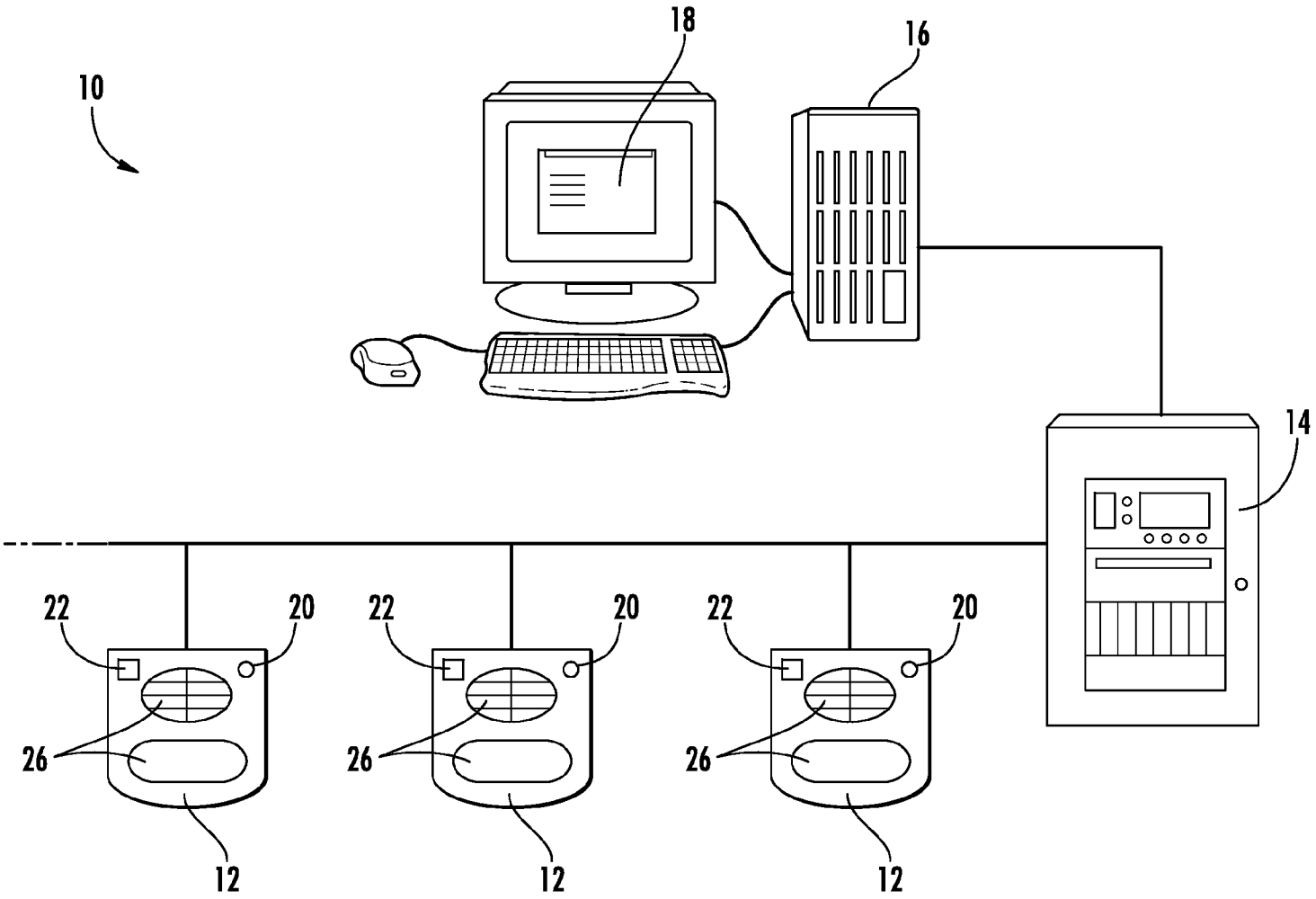
FIG. 1 is a schematic diagram illustrating an exemplary embodiment of an alarm system in accordance with the present disclosure.

Methods for inspecting and testing notification appliances in accordance with the present disclosure will now be described more fully hereinafter with reference to the accompanying drawings, in which preferred embodiments of the invention are shown. The disclosed methods, however, may be embodied in many different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout.

It will be appreciated by those of ordinary skill in the art that the methods described herein may be implemented in virtually any type of alarm or monitoring system, including, but not limited to, fire alarm systems, burglar alarm systems, surveillance systems, air quality monitoring systems, inventory monitoring systems, etc., or any combination thereof, such as may be provided for detecting an alarm event (e.g. a security breach) or a warning condition (e.g. an elevated temperature) in a building, structure, enclosure, or area. Many other applications are contemplated and may be implemented without departing from the scope of the present disclosure. All such applications are collectively referred to herein as "alarm systems."

Referring to FIG. 1, an exemplary alarm system 10 in accordance with the present disclosure is shown. The alarm system 10 may include a plurality of notification appliances 12 that may be installed throughout a monitored structure and connected to one or more alarm panels 14. Each notification appliance 12 may be associated with a unique address within the alarm system 10 for facilitating identification thereof by the alarm panel 14 and enabling selective routing of command/control signals from the alarm panel 14 to each notification appliance 12. The notification appliances 12 may be configured to provide notification of an alarm condition within the structure, such as may be detected by one or more initiating devices (not shown) in the alarm system 10. The notification appliances 12 shown in FIG. 1 are strobe/horn units, but it is contemplated that other varieties of notification appliances, such as sirens, bells, buzzers, etc., may additionally or alternatively be implemented in the alarm system 10 in a similar manner. For the sake of convenience and clarity, only three notification appliances 12 are shown, but it is to be understood that the alarm system may include many additional notification appliances 12 without departing from the scope of the present disclosure.

The exemplary alarm system 10 may also include a workstation 16, such as a personal computer (PC) or server, which is operatively connected to the alarm panel 14. The workstation 16 may be loaded with one or more software applications that provide human operators of the system 10 with a user interface 18 for monitoring and controlling certain aspects of the alarm system 10. For example, the user interface 18 may allow an operator to observe the functional status of the notification appliances 12, and to activate, deactivate, test, inspect, or otherwise exert control over the notification appliances 12 as further described below. Alternatively, it is contemplated that the workstation 16 and user interface 18 may be entirely omitted from the alarm system 10, and that an operator may activate, deactivate, test, inspect, observe the functional status of, or otherwise exert control over the notification appliances 12 via the alarm panel 14.

Each of the notification appliances 12 may be equipped with one or more verification indicia 20. The verification indicia 20 may be configured to be activated in response to a command signal from the alarm panel 14 or workstation 16, such as may be sent when the alarm system 10 is placed in an "inspection mode" or a "test mode" as further described below. The verification indicia 20 may include any type of visual indicia that are capable of being activated in response to an electrical signal, including, but not limited to, light emitting diodes (LEDs), incandescent light bulbs, fluorescent light bulbs, liquid crystal displays (LCDs), strobes, and the like. Such visual indicia 20 may be prominently located on the exteriors of the notification appliances 12. The verification indicia 20 may additionally or alternatively include any type of audible indicia that are capable of being activated in response to an electrical signal, including, but not limited to, sirens, horns, bells, buzzers, and the like.

Each of the notification appliances 12 may further be provided with a manually actuated input device 22, such as a switch or a button. The input devices 22 may be configured such that actuation of an input device 22 may cause a previously activated verification indicium 20 of a respective notification appliance 12 to be deactivated, and may further cause the respective notification appliance 12 to be activated (e.g. to strobe and sound) for a predefined amount of time (e.g. 10 seconds) for allowing an inspector to determine whether the appliance 12 is operating properly. The purpose and operation of the input devices 22 will be described in greater detail below within the context of the disclosed inspection and testing methods.

The input devices 22 shown in FIG. 1 may be magnetic switches that are actuated by waving a magnetic key 24 (shown in FIG. 5) in close proximity thereto. Such magnetic keys 24 may be made available to a designated system inspector or group of designated system inspectors, and may further be encoded with identifying information, although this is not critical. Limiting access to the input devices 22 in this manner is advantageous because it prevents unauthorized individuals from interfering with the inspection and testing of the alarm system 10. However, it is contemplated that various other types of input devices 22 may additionally or alternatively be implemented without departing from the present disclosure. For example, it is contemplated that the input devices 22 may be simple buttons or switches that can be actuated by any individual.

Figure 2:
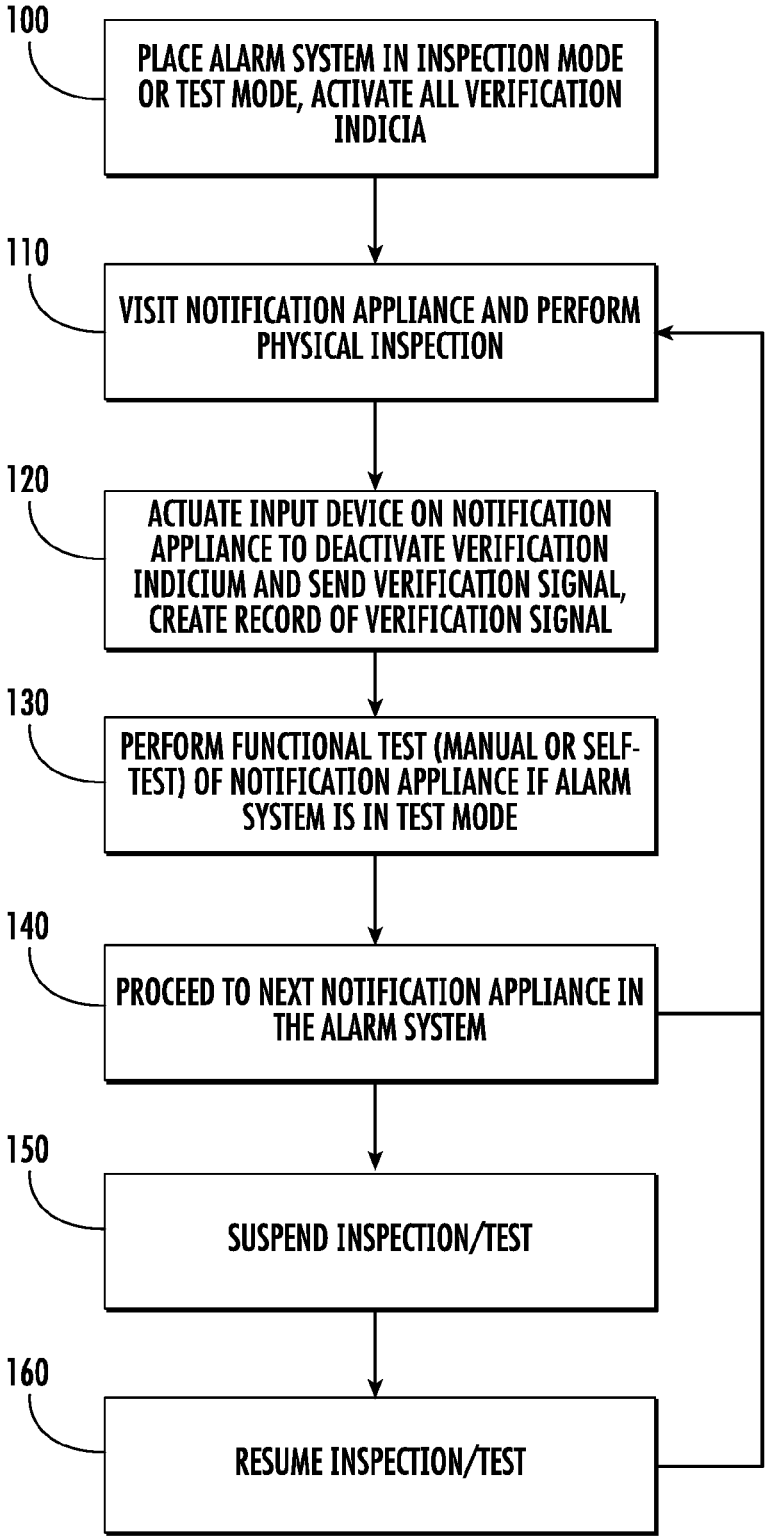
FIG. 2 is a flow diagram illustrating an exemplary embodiment of a method in accordance with the present disclosure.

Referring to FIG. 2, a flow diagram illustrating an exemplary method for inspecting and testing the notification appliances 12 of the alarm system 10 in accordance with the present disclosure is shown. Such method will now be described in detail in conjunction with the schematic representations of the alarm system 10 shown in FIGS. 3-10.

Figure 3:
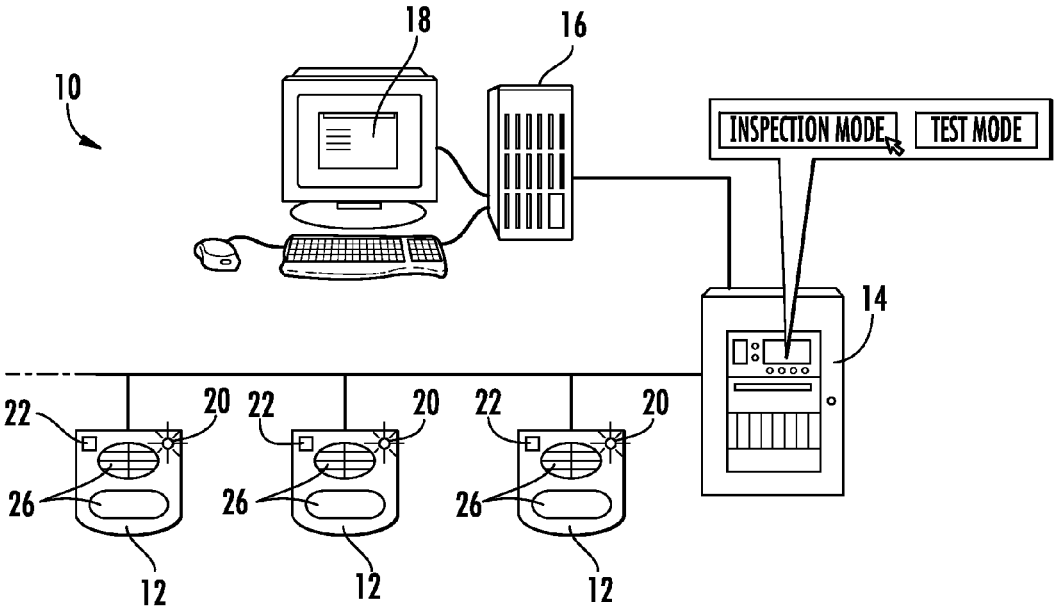
FIGS. 3-10 are a series of schematic diagrams illustrating the exemplary method shown in FIG. 2 being performed upon the alarm system shown in FIG. 1.

At a first step 100 of the exemplary method, an inspector may place the system 10 in an "inspection mode" if the inspector wishes to conduct only a physical inspection of the notification appliances 12. Alternatively, if the inspector wishes to conduct a physical inspection and a functional test of the notification appliances 12, the inspector may place the system in a "test mode". Either mode may be initiated by making an appropriate selection in the user interface 18 or at the alarm panel 14, such as by selecting an "INSPECTION MODE" or "TEST MODE" option in a menu or sub-menu of the alarm panel 14 as shown in FIG. 3. If the "test mode" is selected, the inspector may further be provided with an option to initiate a "self-test" of the alarm system (further described below). Initiating either the "inspection mode" or the "test mode" may cause the verification indicia 20 of every notification appliance 12 to be activated, as also shown in FIG. 3.

Figure 4:
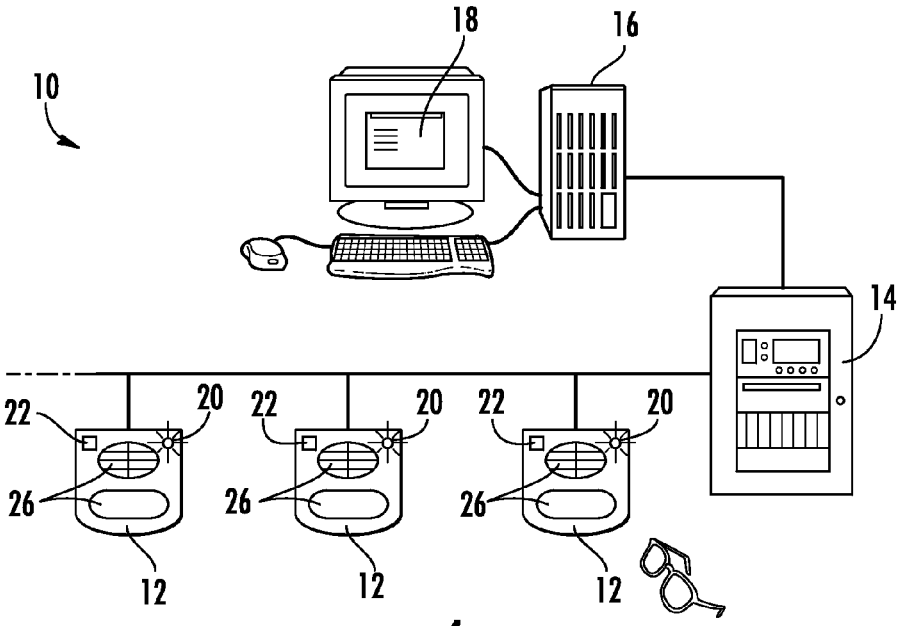

At step 110 of the exemplary method, the inspector may visit a first of the notification appliances 12 and may perform a physical inspection thereof as shown in FIG. 4 (physical inspection of the rightmost notification appliance 12 is indicated by the eyeglasses). During such inspection, the inspector may determine whether the physical state of the notification appliance 12 has been compromised in any way. For example, the inspector may determine whether the notification appliance 12 has been painted over, whether it has come loose from a mounting on a wall or a ceiling, or whether the housing of the notification appliance 12 has been damaged. The inspector may make note of observations made during such inspection, including whether the notification appliance 12 should be repaired or replaced.

Figure 5:
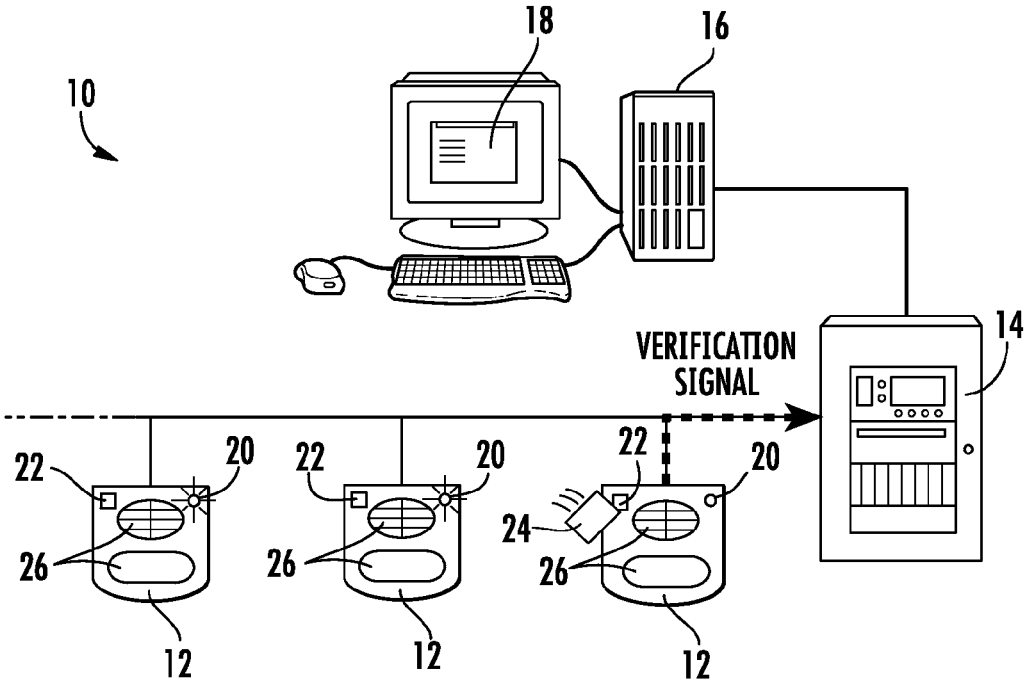

After the inspector has completed his or her physical inspection of the first notification appliance 12, the inspector may, at step 120 of the exemplary method, actuate the input device 22 of the notification appliance 12. For example, the inspector may wave a magnetic key 30 (described above) in close proximity to the input device 22 as shown in FIG. 5. Actuating the input device 22 thusly may result in several actions being performed automatically.

First, the verification indicium 20 on the notification appliance 12 may be extinguished, thereby indicating to subsequent observers (e.g. other inspectors) that the notification appliance 12 has been inspected. The verification indicia 20 therefore allow inspectors to avoid accidental multiple inspections of a notification appliance 12, such as may occur if an inspector does not know that an appliance has already been tested. The verification indicia 20 further allow inspectors to avoid accidental non-inspection of a notification appliance 12, such as may occur if an inspector believes that an appliance has already been tested when it in-fact has not.

A second action that may be performed upon actuation of the input device 22 is that the inspected notification appliance 12 may transmit a verification signal to the alarm panel 14 as indicated by the dashed arrow in FIG. 5. Upon receiving such verification signal, the alarm panel 14 may record the unique address of the inspected notification appliance 12, and may also record the date and time when the verification signal was received. The alarm panel 14 may further record a unique identification number associated with the magnetic key 30 that was used to actuate the input device 22 if such information was captured by the notification appliance 12 and conveyed by the verification signal. By collecting such information, the alarm panel 14 may create and store a record of when and by whom the notification appliance 12 was inspected. Such a record may subsequently be reviewed by interested parties, and may provide confirmation that a particular notification appliance 12 was in-fact physically inspected. Alternatively, it is contemplated that the above-described the functions of receiving the verification signal, creating an inspection record, as well as all other command, control, and storage functions described below, may instead be performed by the workstation 16.

Figure 6:
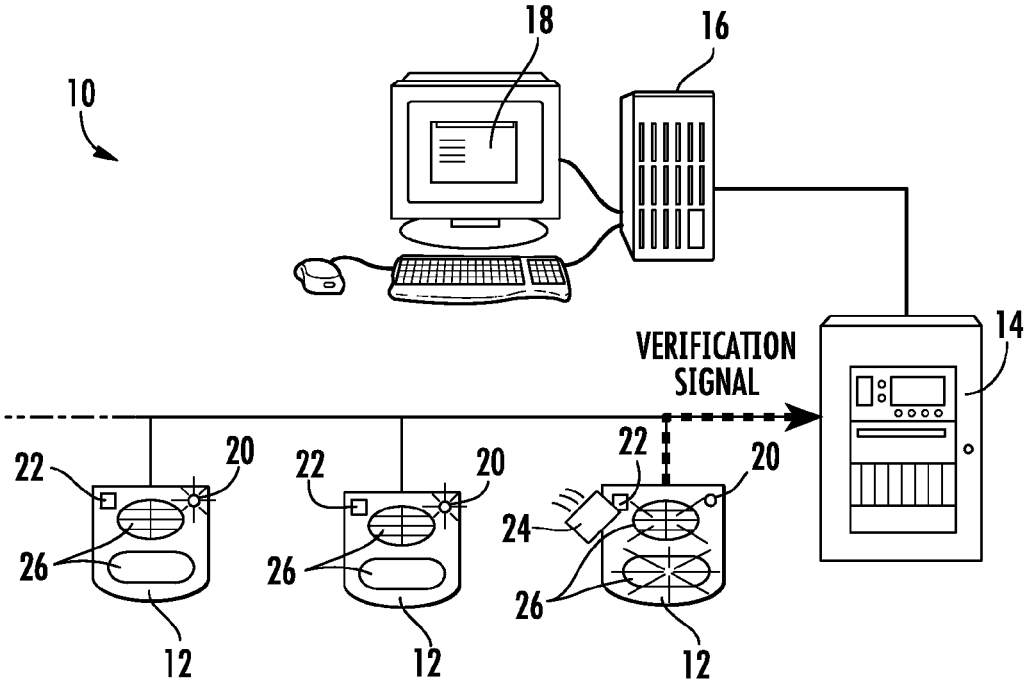

If the alarm system 10 was placed in the "test mode" in step 100 above, the inspected notification appliance 12 (i.e. the rightmost notification appliance in FIG. 4) may, at step 130 of the exemplary method, perform a third action upon actuation of the input device 22 in addition to extinguishing its verification indicium 20 and transmitting a verification signal to the alarm panel 14. Particularly, the notification appliance may perform a functional test by activating its notification features 26 (such test will not be performed if the alarm 10 was placed in the "inspection mode" in step 100 above). For example, the notification appliance 12 may flash its strobe and/or sound its horn for a predefined amount of time (e.g. 10 seconds) as shown in FIG. 6. Of course, the particular type of functional test performed will depend on the particular type of notification appliance 12 being tested.

The functional test may allow the inspector to determine whether the notification appliance 12 is able to operate as intended (e.g. at a sufficient volume or brightness). Upon completion of the test, the inspector may make note of observations made during the functional test, including whether the notification appliance 12 is in need of repair or replacement. Additionally, the verification signal transmitted to the alarm panel 14 (described above) may include information indicating that a functional test was performed, and such information may be entered into the inspection record (described above).

It is contemplated that one or more of the notification appliances 12 may be equipped with a so-called "self-test" feature which enables a notification appliance 12 to automatically evaluate its own functionality. For example, such a notification appliance 12 may include one or more sensors (not shown), such as a microphone, sound detector, camera, photo eye, light detector, etc., located adjacent the appliance's notification features 26 (e.g. strobes, horns, sirens, etc.). Upon initiating a self-test of a properly equipped notification appliance 12, such as by actuating the input device 22 as in step 130 of the exemplary method, the notification appliance 12 may activate its notification features 26 to perform a functional test as described above. While the functional test is being performed, the sensor(s) of the notification appliance 12 may measure the output of the appliance's notification features 26. The measured output may then be compared to predefined values to determine whether the notification appliance 12 is functioning properly. Such comparison may be performed by the notification appliance 12 itself or by the alarm panel 14 or workstation 16, and the results of the self-test may be automatically entered into the inspection record (described above) created by the alarm panel 14. The inspector is thereby relieved from having to observe and manually record the results of the functional test.

Figure 7:
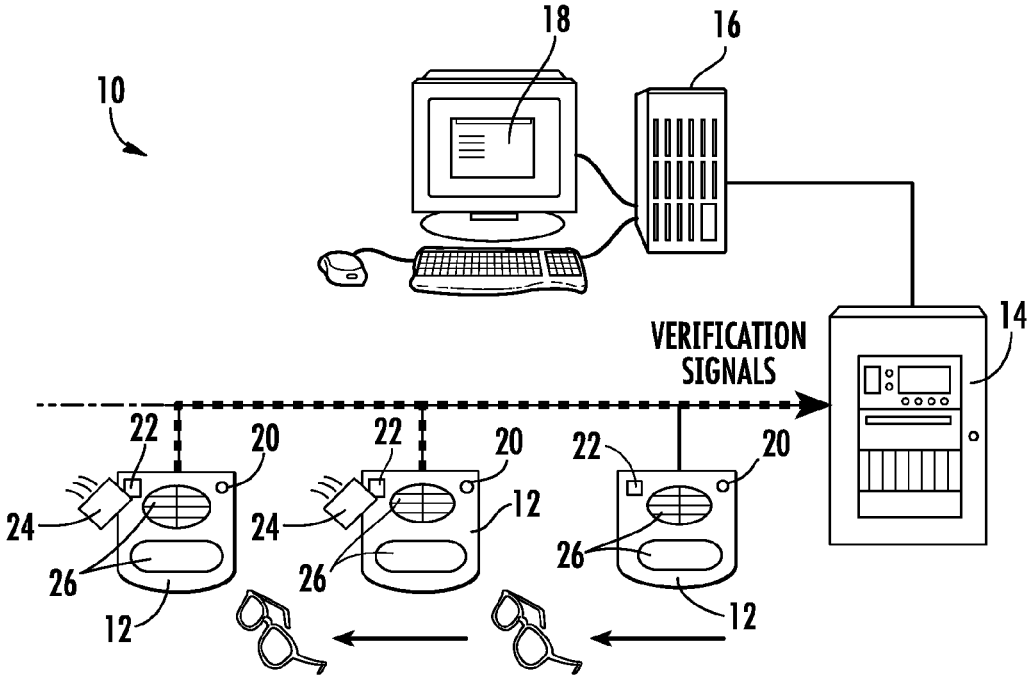
Figure 8:
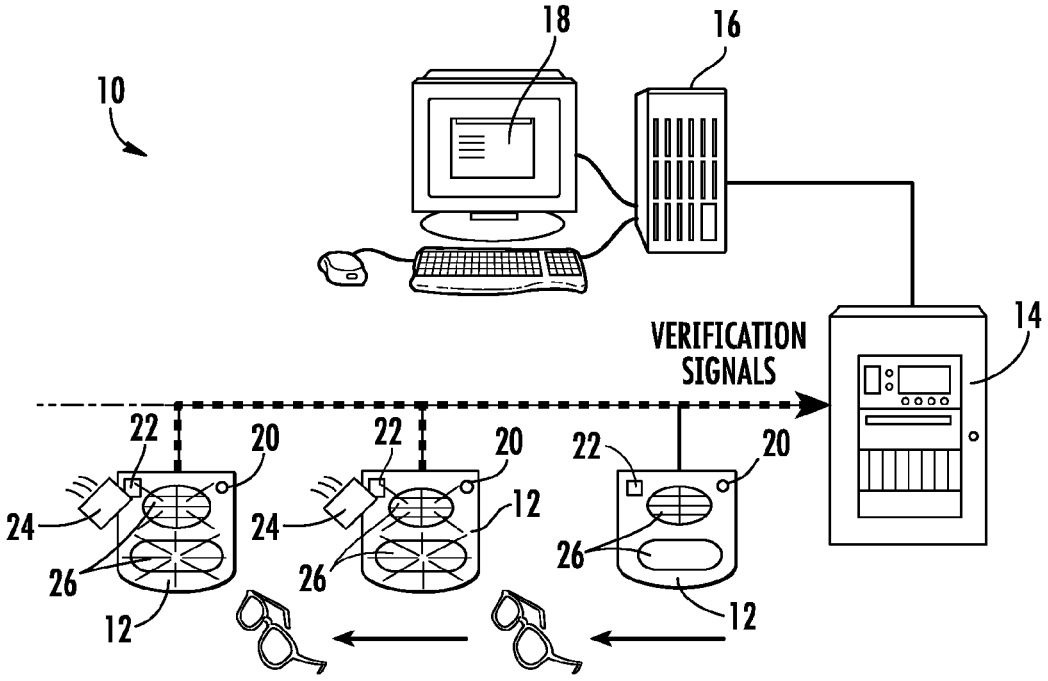

At step 140 of the exemplary method, the inspector may proceed to the other notification appliances 12 in the alarm system 10 and may sequentially inspect each appliance in the manner described in steps 110 and 120 above (i.e. if the alarm system 10 is in the "inspection mode") as shown in FIG. 7, or may sequentially inspect and test (manually test or self-test) each appliance in the manner described in steps 110-130 above (i.e. if the alarm system 10 is in the "inspection mode") as shown in FIG. 8. Particularly, the inspector may physically inspect each remaining notification appliance 12 and may actuate the input device 22 of each appliance, thereby extinguishing each verification indium 20, causing each notification appliance 12 to perform a functional test (i.e. if the alarm system 10 is in the "test mode"), and transmit a verification signal to the alarm panel 14. A full inspection and functional test record for the entire alarm system 10 may thereby be created and stored by the alarm panel 14 in the manner described above.

Figure 9:
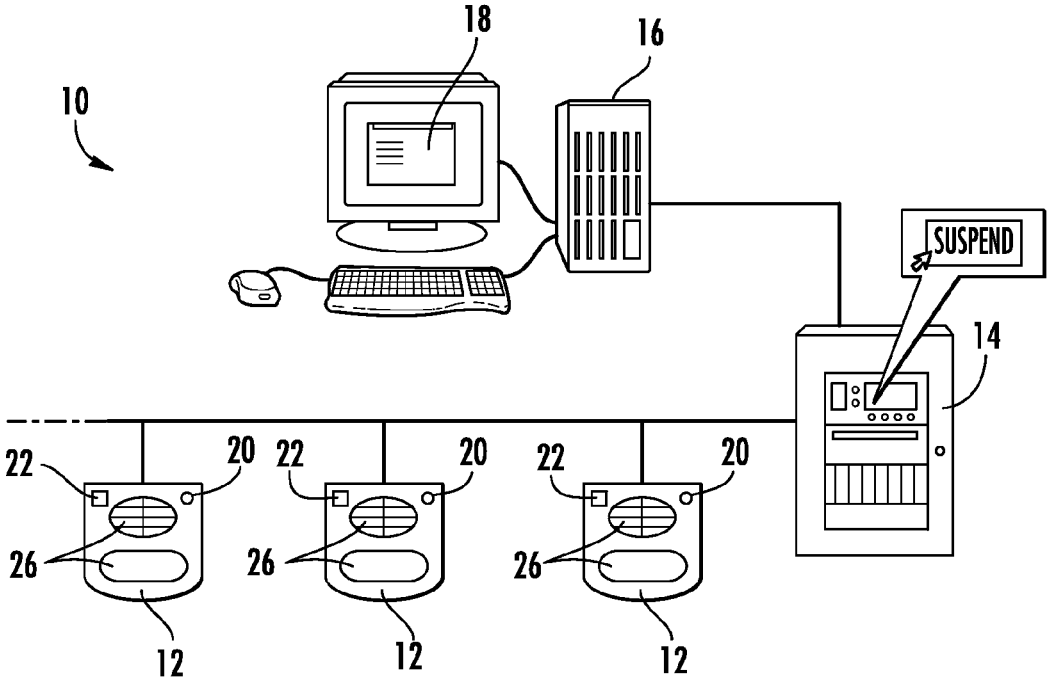

At step 150 of the exemplary method, the inspector may, at any time after an inspection/test of the alarm system 10 has begun and before such inspection/test has been ended, return to the alarm panel 14 (or, optionally, the workstation 16) and suspend the inspection/test, such as by selecting a "SUSPEND" or similarly labeled option in a menu or sub-menu of the alarm panel 14 as shown in FIG. 9. Suspending the inspection/test of the alarm system 10 in this manner may cause the verification indicia 20 of any notification appliances 12 that have not yet been physically inspected/tested to be extinguished, and may cause the alarm system 10 to return to normal operation. Each notification appliance 12 in the alarm system 10 may further record, such in onboard memory, the state that it was in (i.e. inspected/tested or not inspected/tested) upon suspension of the inspection/test. Alternatively or additionally, it is contemplated that the alarm panel 14 may record the unique addresses of the notification appliances 12 that have not yet been inspected/tested.

Figure 10:
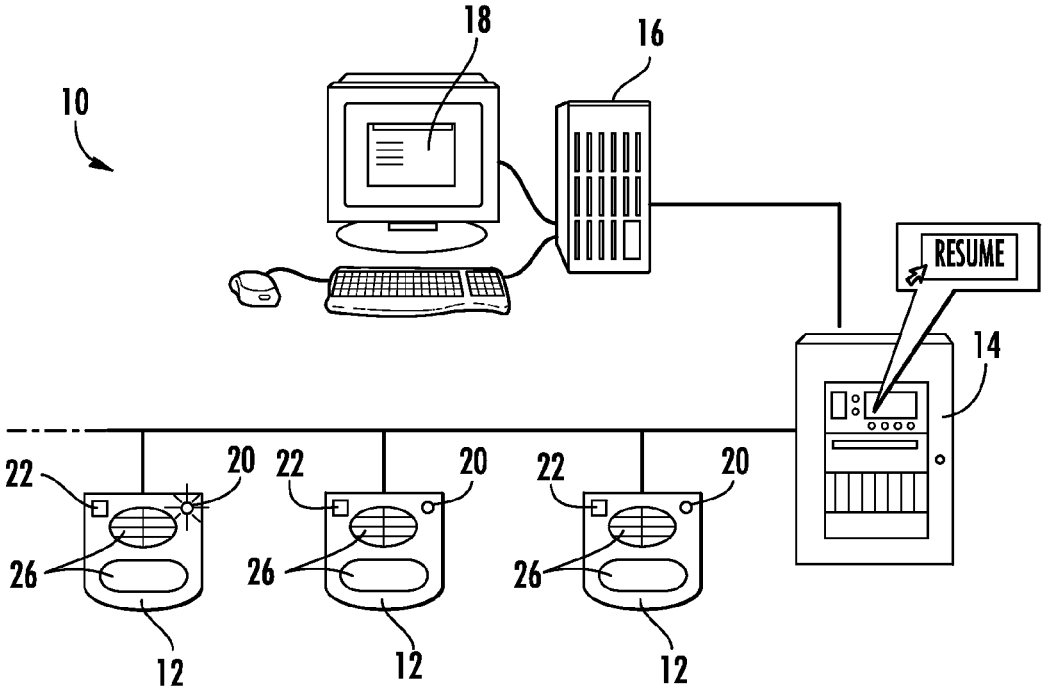

At step 160 of the exemplary method, the inspector may return to the alarm panel 14 (or, optionally, the workstation 16) at some later time and may resume the inspection/test that was suspended in step 160, such as by selecting a "RESUME"

or similarly labeled option in a menu or sub-menu of the alarm panel 14 as shown in FIG. 10. Resuming the inspection/test of the alarm system 10 in this manner may place the alarm system 10 back in the mode (i.e. inspection or test) it was in prior to suspension of the inspection/test, and the verification indicia 20 of any notification appliances 12 that were not inspected/tested prior to suspension of the inspection/test (e.g. the leftmost notification appliance 12 in FIG. 10) may be illuminated, thereby allowing the inspector to easily determine which notification appliances 12 must still be inspected/tested. The inspector is thereby relieved from having to manually maintain his or her own records of which appliances were/were not inspected/tested prior to the suspension. This suspend/resume feature of the alarm system 10 may be useful in cases where inspection/testing of the alarm system 10 must be performed over a number of days and returned to normal operation overnight, or where inspection/testing is unexpectedly interrupted for some reason.

Figure 11:
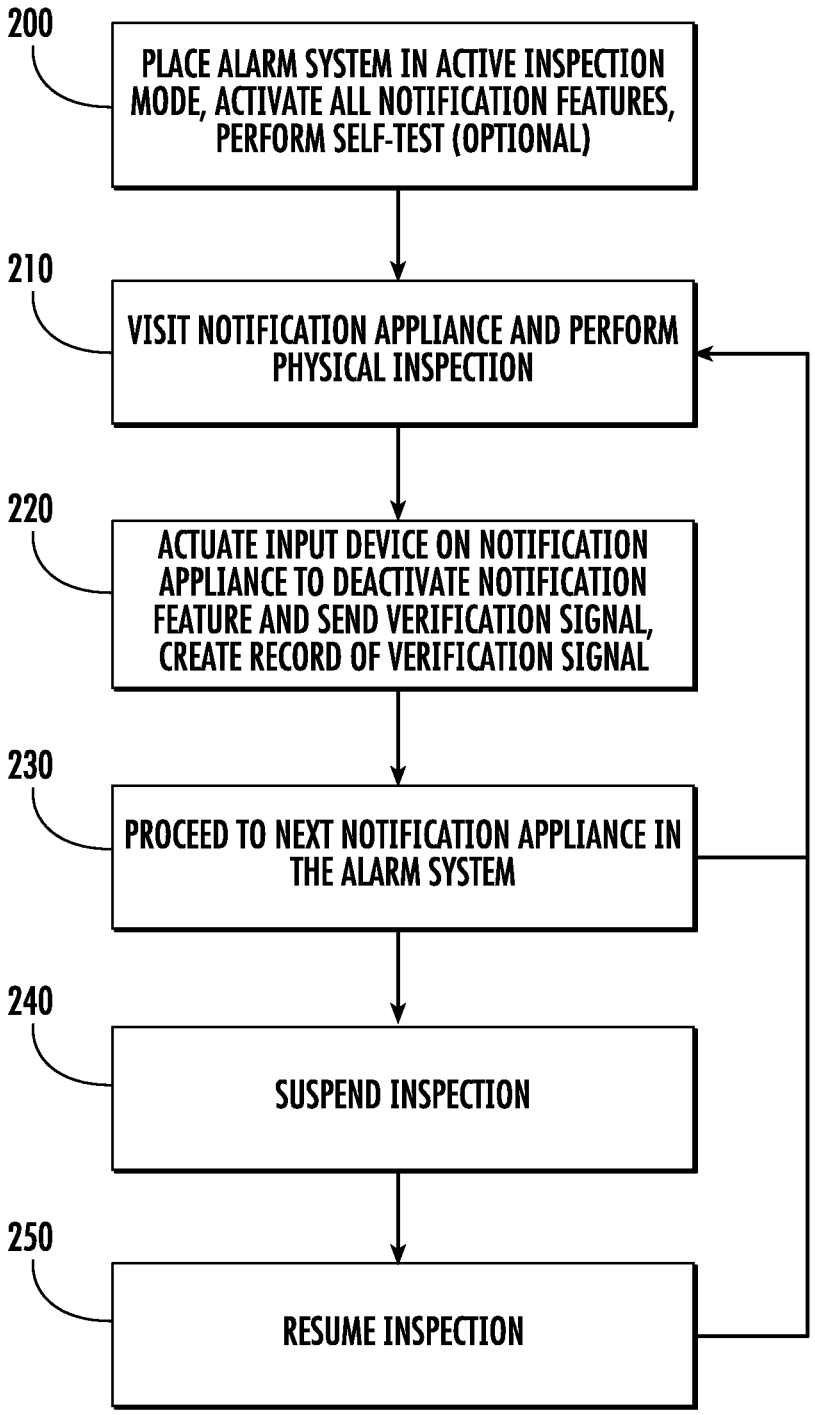
FIG. 11 is a flow diagram illustrating a second exemplary embodiment of a method in accordance with the present disclosure.

Referring to FIG. 11, a flow diagram illustrating a second exemplary method for inspecting and testing the notification appliances 12 of the alarm system 10 in accordance with the present disclosure is shown. Such method will now be described in detail in conjunction with the schematic representations of the alarm system 10 shown in FIGS. 12-17. It should be noted that the above-described verification indicia 20 are not shown in FIGS. 12-17 because such indicia are not employed in this method and may therefore be entirely omitted from the alarm system 10.

Figure 12:
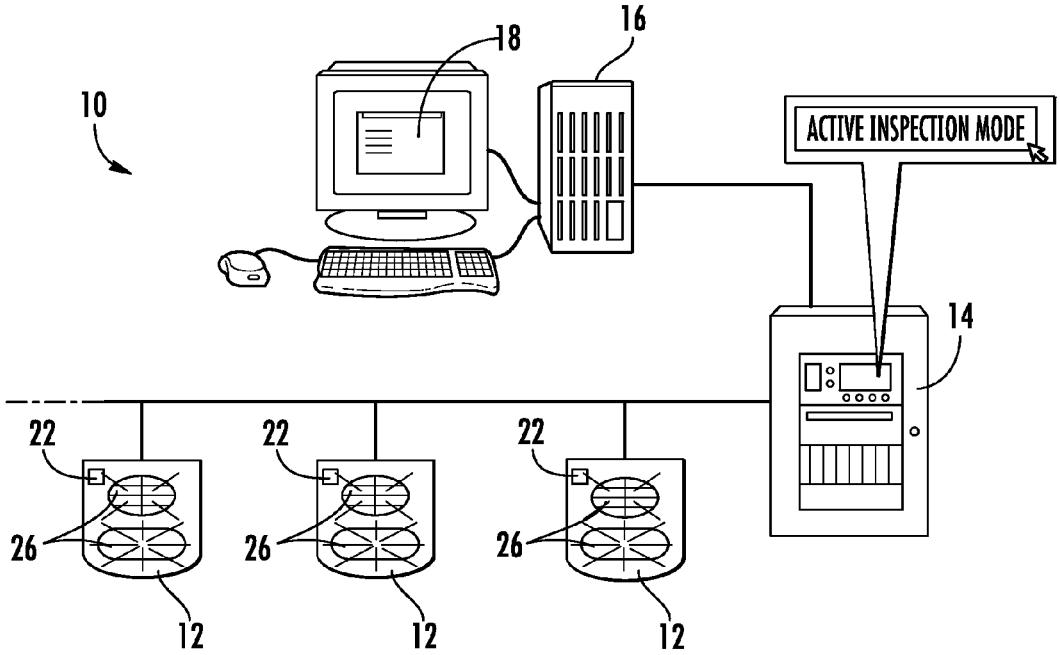
FIGS. 12-17 are a series of schematic diagrams illustrating the exemplary method shown in FIG. 11 being performed upon the alarm system shown in FIG. 1.

At a first step 200 of the exemplary method, an inspector may place the system 10 in an "active inspection mode," such as by selecting an "ACTIVE INSPECTION MODE" or similarly labeled option in a menu or sub-menu of the alarm panel 14 as shown in FIG. 12. Initiating this mode may cause all of the notification features 26 (e.g. strobes, horns, sirens, etc.) of every notification appliance 12 to be activated, as also shown in FIG. 12.

Figure 13:
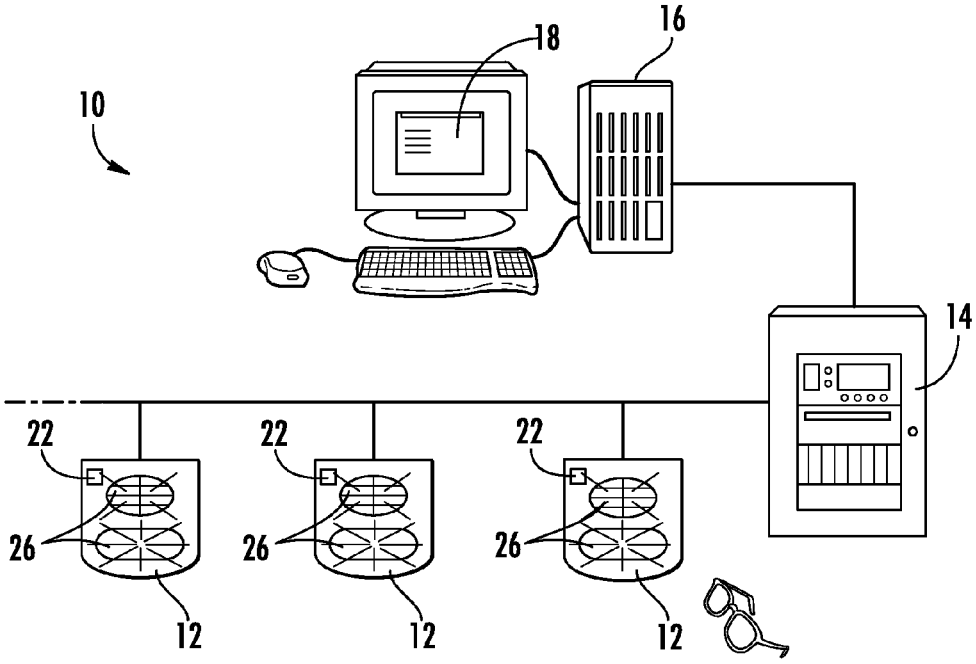

At step 210 of the exemplary method, the inspector may visit a first of the notification appliances 12 and may perform an inspection thereof as shown in FIG. 13 (inspection of the rightmost notification appliance 12 is indicated by the eyeglasses). During such inspection, the inspector may determine whether the physical state of the notification appliance 12 has been compromised in any way. For example, the inspector may determine whether the notification appliance 12 has been painted over, whether it has come loose from a mounting on a wall or a ceiling, or whether the housing of the notification appliance 12 has been damaged. The inspector may further observe the active notification features 26 of the notification appliance 12 and may determine whether such features are operating properly. Alternatively (i.e. instead of the inspector determining whether the notification features 26 are operating properly), it is contemplated that the notification appliance 12 may perform a self-test (described above) upon activation of the notification features 26 in step 200, wherein the results of such self-test are recorded by the alarm panel 14. The inspector may make note of observations that were made during the inspection, including whether the notification appliance 12 should be repaired or replaced.

Figure 14:
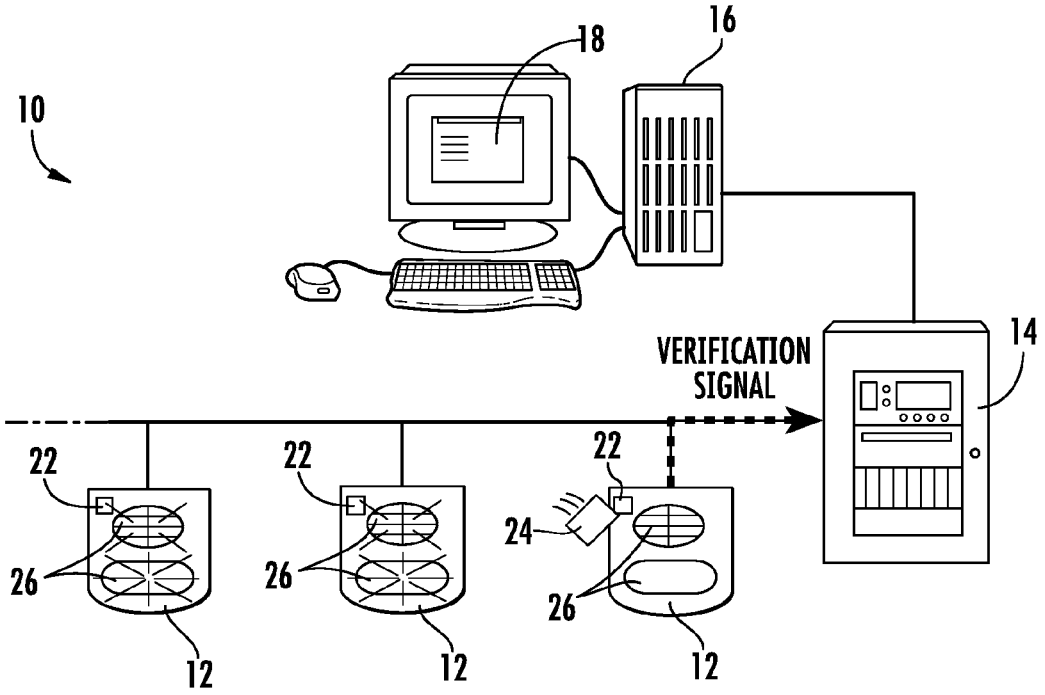

After the inspector has completed his or her inspection of the first notification appliance 12, the inspector may, at step 220 of the exemplary method, actuate the input device 22 of the notification appliance 12. For example, the inspector may wave a magnetic key 30 (described above) in close proximity to the input device 22 as shown in FIG. 14. Actuating the input device 22 thusly may result in several actions being performed automatically.

First, the notification features 26 of the notification appliance 12 may be deactivated, thereby indicating to subsequent observers (e.g. other inspectors) that the notification appliance 12 has been inspected. The notification features 26 therefore allow inspectors to avoid accidental multiple inspections of a notification appliance 12, such as may occur if an inspector does not know that an appliance has already been tested. The notification features 26 further allow inspectors to avoid accidental non-inspection of a notification appliance 12, such as may occur if an inspector believes that an appliance has already been tested when it in-fact has not.

A second action that may be performed upon actuation of the input device 22 is that the inspected notification appliance 12 may transmit a verification signal to the alarm panel 14 as indicated by the dashed arrow in FIG. 14. Upon receiving such verification signal, the alarm panel 14 may record the unique address of the inspected notification appliance 12, and may also record the date and time when the verification signal was received. The alarm panel 14 may further record a unique identification number associated with the magnetic key 30 that was used to actuate the input device 22 if such information was captured by the notification appliance 12 and conveyed by the verification signal. By collecting such information, the alarm panel 14 may create and store a record of when and by whom the notification appliance 12 was inspected. Such a record may subsequently be reviewed by interested parties, and may provide confirmation that a particular notification appliance 12 was in-fact inspected.

Figure 15:
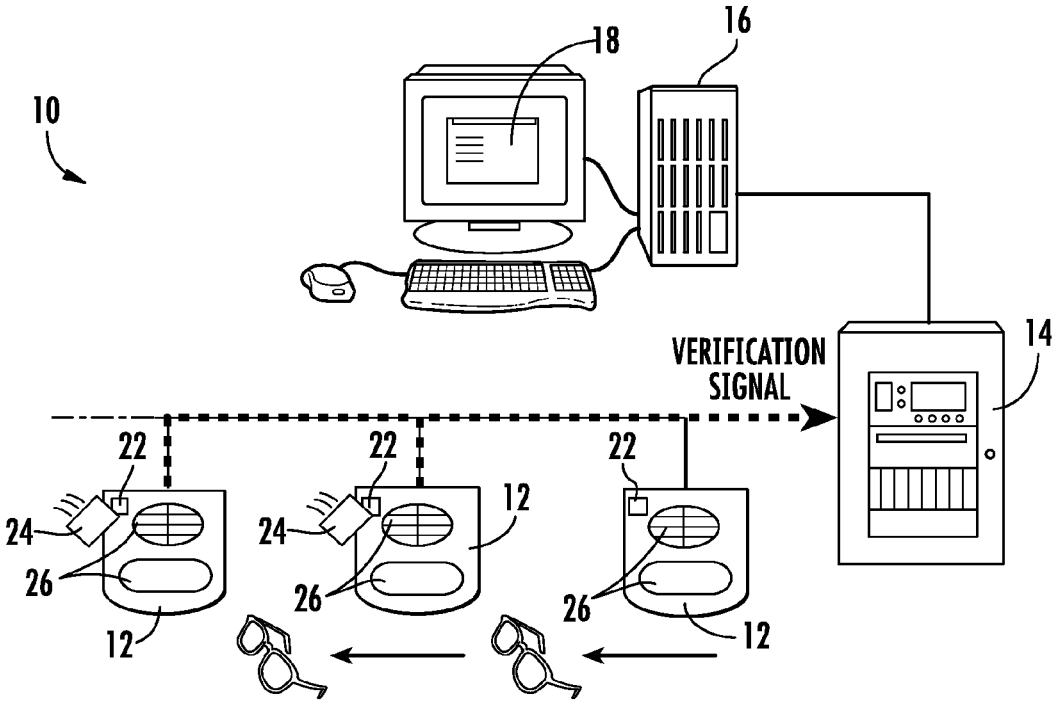

At step 230 of the exemplary method, the inspector may proceed to the other notification appliances 12 in the alarm system 10 and sequentially inspect each appliance in the manner described in steps 210-220, as shown in FIG. 15. Particularly, the inspector may inspect each remaining notification appliance 12 and may actuate the input device 22 of each appliance, thereby extinguishing each notification feature 26 and causing each notification appliance 12 to transmit a verification signal to the alarm panel 14. A full inspection record for the entire alarm system 10 may thereby be created and stored by the alarm panel 14 in the manner described above.

A benefit of the exemplary method described in steps 200-230 is that, by virtue of all of the notification features 26 of the notification appliances 12 being activated at the beginning of the inspection, the notification appliances 12 are very easy to find and are unlikely to be missed during the course of inspection. For example, an inspector may use the sound of an active horn to guide him or her to an uninspected notification appliance. Moreover, the building or area in which the alarm system 10 is installed may generally not be completely quiet until all of the notification appliances 12 have been inspected and their notification features 26 deactivated. The exemplary method thereby mitigates the chances of incomplete inspections.

Figure 16:
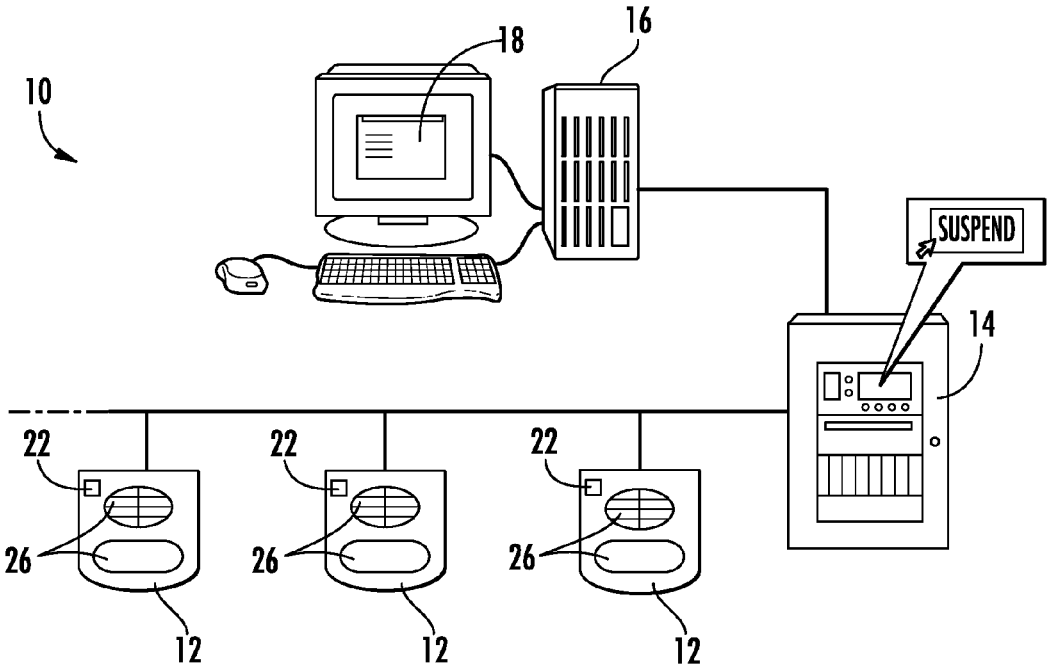

At step 250 of the exemplary method, the inspector may, at any time after an inspection of the alarm system 10 has begun and before such inspection has been ended, return to the alarm panel 14 (or, optionally, the workstation 16) and suspend the inspection, such as by selecting a "SUSPEND" or similarly labeled option in a menu or sub-menu of the alarm panel 14 as shown in FIG. 16. Suspending the inspection of the alarm system 10 in this manner may cause the alarm panel 14 to deactivate the notification features 26 of any notification appliances 12 that have not yet been inspected, and may cause the alarm system 10 to return to normal operation. Each notification appliance 12 in the alarm system 10 may further record, such in onboard memory, the state that it was in (i.e. inspected/tested or not inspected/tested) upon suspension of the inspection/test. Alternatively or additionally, it is contemplated that the alarm panel 14 may record the unique addresses of the notification appliances 12 that have not yet been inspected/tested.

Figure 17:
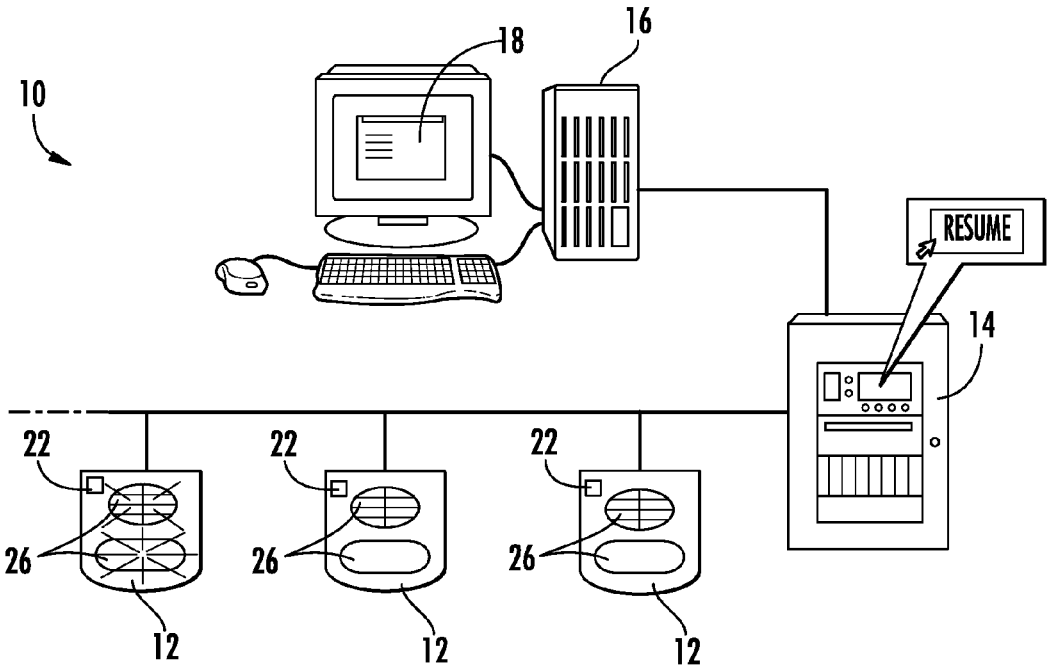

At step 260 of the exemplary method, the inspector may return to the alarm panel 14 (or, optionally, the workstation 16) at some later time and may resume the inspection that was suspended in step 250, such as by selecting a "RESUME" or similarly labeled option in a menu or sub-menu of the alarm panel 14 as shown in FIG. 17. Resuming the inspection of the alarm system 10 in this manner may place the alarm system 10 back in the "active inspection mode" it was in prior to suspension of the inspection. The alarm panel 14 may further activate the notification features 26 of any notification appliances 12 that were not inspected prior to suspension of the inspection (e.g. the leftmost notification appliance 12 in FIG. 17), thereby allowing the inspector to easily determine which notification appliances 12 must still be inspected without requiring the inspector to manually maintain his or her own records of inspection. This suspend/resume feature of the alarm system 10 may be useful in cases where inspection of the alarm system 10 must be performed over a number of days and returned to normal operation at night, or where inspection is unexpectedly interrupted for some reason.

The methods described herein thus provide inspectors and other interested parties with convenient means for verifying that each and every notification appliance in an alarm system has been tested and physically inspected. The system and methods described herein further provide convenient means for keeping track of which notification appliances in an alarm system have been tested and inspected and which have not. Still further, the system and methods described herein provide convenient means for allowing inspectors to easily find notification appliances in building or area.

As used herein, an element or step recited in the singular and proceeded with the word "a" or "an" should be understood as not excluding plural elements or steps, unless such exclusion is explicitly recited. Furthermore, references to "one embodiment" of the present invention are not intended to be interpreted as excluding the existence of additional embodiments that also incorporate the recited features.

While certain embodiments of the disclosure have been described herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

The various embodiments or components described above may be implemented as part of one or more computer systems. Such a computer system may include a computer, an input device, a display unit and an interface, for example, for accessing the Internet. The computer may include a microprocessor. The microprocessor may be connected to a communication bus. The computer may also include memories. The memories may include Random Access Memory (RAM) and Read Only Memory (ROM). The computer system further may include a storage device, which may be a hard disk drive or a removable storage drive such as a floppy disk drive, optical disk drive, and the like. The storage device may also be other similar means for loading computer programs or other instructions into the computer system.

As used herein, the term "computer" may include any processor-based or microprocessor-based system including systems using microcontrollers, reduced instruction set circuits (RISCs), application specific integrated circuits (ASICs), logic circuits, and any other circuit or processor capable of executing the functions described herein. The above examples are exemplary only, and are thus not intended to limit in any way the definition and/or meaning of the term "computer."

The computer system executes a set of instructions that are stored in one or more storage elements, in order to process input data. The storage elements may also store data or other information as desired or needed. The storage element may be in the form of an information source or a physical memory element within the processing machine.

The set of instructions may include various commands that instruct the computer as a processing machine to perform specific operations such as the methods and processes of the various embodiments of the invention. The set of instructions may be in the form of a software program. The software may be in various forms such as system software or application software. Further, the software may be in the form of a collection of separate programs, a program module within a larger program or a portion of a program module. The software also may include modular programming in the form of object-oriented programming. The processing of input data by the processing machine may be in response to user commands, or in response to results of previous processing, or in response to a request made by another processing machine.

As used herein, the term "software" includes any computer program stored in memory for execution by a computer, such memory including RAM memory, ROM memory, EPROM memory, EEPROM memory, and non-volatile RAM (NVRAM) memory. The above memory types are exemplary only, and are thus not limiting as to the types of memory usable for storage of a computer program.

The invention claimed is:

1. A method for inspecting notification appliances in an alarm system, the method comprising:

placing the alarm system in an inspection mode, whereby a verification indicium on each notification appliance being inspected is activated;

actuating an input device on one of the notification appliances, whereby the verification indicium on the notification appliance is deactivated;

transmitting a verification signal from the notification appliance; and creating a record of the verification signal, such record including an address of the notification appliance, a time and date when the verification signal was received, and an identifier associated with a key that was used to actuate the input device.

2. The method of claim 1, further comprising storing the record and making the record available for subsequent review.

3. The method of claim 1, wherein the step of placing the alarm system in the inspection mode comprises selecting a corresponding inspection mode option.

4. The method of claim 1, further comprising repeating the step of actuating an input device for every other notification appliance in the alarm system.

5. The method of claim 1, wherein the step of actuating the input device comprises disposing a magnet in close proximity to a magnetic switch in the notification appliance.

6. A method for inspecting notification appliances in an alarm system, the method comprising:

placing the alarm system in an inspection mode, whereby a verification indicium on each notification appliance being inspected is activated;

actuating an input device on one of the notification appliances, whereby the verification indicium on the notification appliance is deactivated;

transmitting a verification signal from the notification appliance; and suspending the inspection before all of the notification appliances in the alarm system have been inspected, whereby the verification indicia of all of the uninspected notification appliances are deactivated, addresses associated with each of the uninspected notification appliances are stored, and the alarm system is returned to normal operation.

7. The method of claim 6, further comprising resuming the inspection, whereby the alarm system is again placed in the inspection mode and the verification indicia of all of the uninspected notification appliances are reactivated.

8. A method for inspecting and testing notification appliances in an alarm system, the method comprising:

placing the alarm system in an test mode, whereby a verification indicium on each notification appliance being inspected and tested is activated;

actuating an input device on one of the notification appliances, whereby the verification indicium on the notification appliance is deactivated and a notification feature of the notification appliance is activated for a predefined amount of time;

transmitting a verification signal from the notification appliance; and creating a record of the verification signal, such record including an address of the notification appliance, a time and date when the verification signal was received, and an identifier associated with a key that was used to actuate the input device.

9. The method of claim 8, further comprising storing the record and making the record available for subsequent review.

10. The method of claim 8, further comprising verifying that the notification feature operated properly.

11. The method of claim 8, further comprising the notification appliance performing a self-test, whereby a result of such self-test is automatically recorded.

12. The method of claim 8, wherein the step of placing the alarm system in the test mode comprises selecting a corresponding test mode option in a user interface of a workstation.

13. The method of claim 8, further comprising repeating the step of actuating an input device for every other notification appliance in the alarm system.

14. The method of claim 8, wherein the step of actuating the input device comprises disposing a magnet in close proximity to a magnetic switch in the notification appliance.

15. A method for inspecting and testing notification appliances in an alarm system, the method comprising:

placing the alarm system in an test mode, whereby a verification indicium on each notification appliance being inspected and tested is activated;

actuating an input device on the notification appliance, whereby the verification indicium on the notification appliance is deactivated and a notification feature of the notification appliance is activated for a predefined amount of time;

transmitting a verification signal from the notification appliance; and suspending the inspection before all of the notification appliances in the alarm system have been inspected and tested, whereby the verification indicia of all of the uninspected and untested notification appliances are deactivated, addresses associated with each of the uninspected and untested notification appliances are stored, and the alarm system is returned to normal operation.

16. The method of claim 15, further comprising resuming the inspection, whereby the alarm system is again placed in the inspection mode and the verification indicia of all of the uninspected and untested notification appliances are reactivated.

17. A method for inspecting notification appliances in an alarm system, the method comprising:

placing the alarm system in an active inspection mode, whereby a notification feature of each notification appliance being inspected is activated;

actuating an input device on one of the notification appliances, whereby the notification feature of the notification appliance is deactivated; and transmitting a verification signal from the notification appliance; and creating a record of the verification signal, such record including an address of the notification appliance, a time and date when the verification signal was received, and an identifier associated with a key that was used to actuate the input device.

18. The method of claim 17, further comprising storing the record and making the record available for subsequent review.

19. The method of claim 17, further comprising verifying that the notification feature operated properly.

20. The method of claim 17, further comprising the notification appliance performing a self-test, whereby a result of such self-test is automatically recorded.

21. The method of claim 17, wherein the step of placing the alarm system in the active inspection mode comprises selecting a corresponding active inspection mode option.

22. The method of claim 17, further comprising repeating the step of actuating an input device for every other notification appliance in the alarm system.

23. The method of claim 17, wherein the step of actuating the input device comprises disposing a magnet in close proximity to a magnetic switch in the notification appliance.

24. A method for inspecting notification appliances in an alarm system, the method comprising:

placing the alarm system in an active inspection mode, whereby a notification feature of each notification appliance being inspected is activated;

actuating an input device on the notification appliance, whereby the notification feature of the notification appliance is deactivated;

transmitting a verification signal from the notification appliance; and suspending the active inspection before all of the notification appliances in the alarm system have been inspected, whereby the notification features of all of the uninspected notification appliances are deactivated, addresses associated with each of the uninspected notification appliances are stored, and the alarm system is returned to normal operation.

25. The method of claim 24, further comprising resuming the inspection, whereby the alarm system is again placed in the active inspection mode and the notification features of all of the uninspected notification appliances are reactivated.

* * * * *